US006973797B2

(12) United States Patent
Nemit, Jr.

(10) Patent No.: US 6,973,797 B2
(45) Date of Patent: Dec. 13, 2005

(54) CAPACITY CONTROL FOR ECONOMIZER REFRIGERATION SYSTEMS

(75) Inventor: Paul Nemit, Jr., Roanoke, VA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 10/842,272

(22) Filed: May 10, 2004

(65) Prior Publication Data

US 2005/0247071 A1 Nov. 10, 2005

(51) Int. Cl.[7] ..... F25B 41/00; F25B 49/00

(52) U.S. Cl. ..... 62/196.1; 162/197; 162/509; 162/228.1

(58) Field of Search ..... 62/196.1, 196.4, 62/197, 228.1, 509, 175, 510

(56) References Cited

U.S. PATENT DOCUMENTS

| | | | | |
|---|---|---|---|---|
| 3,635,041 | A | | 1/1972 | Endress et al. |
| 4,171,623 | A | | 10/1979 | Lavigne, Jr. et al. |
| 4,232,533 | A | | 11/1980 | Lundblad et al. |
| 4,509,341 | A | | 4/1985 | Zimmern |
| 4,745,777 | A | | 5/1988 | Morishita et al. |
| 4,899,555 | A | | 2/1990 | Shaw |
| 5,063,750 | A | * | 11/1991 | Englund ..... 62/196.3 |
| 5,095,712 | A | | 3/1992 | Narreau |
| 5,634,350 | A | | 6/1997 | De Medio |
| 5,816,055 | A | | 10/1998 | Ohman |
| 6,058,729 | A | * | 5/2000 | Lifson et al. ..... 62/217 |
| 6,202,438 | B1 | | 3/2001 | Barito |
| 6,374,631 | B1 | | 4/2002 | Lifson et al. |
| 6,385,980 | B1 | | 5/2002 | Sienel |
| 6,385,981 | B1 | | 5/2002 | Vaisman |
| 6,820,434 | B1 | * | 11/2004 | Gutheim et al. ..... 62/175 |
| 6,883,341 | B1 | * | 4/2005 | Lifson ..... 62/196.4 |
| 2002/0157409 | A1 | * | 10/2002 | Pham et al. ..... 62/228.3 |

* cited by examiner

*Primary Examiner*—Marc Norman
(74) *Attorney, Agent, or Firm*—McNees Wallace & Nurick LLC

(57) ABSTRACT

An economizer-equipped refrigeration system and method is provided for simultaneous operation of at least one capacity control valve controlling an independent bypass circuit with operation and variable control of the economizer circuit to permit efficient, flexible, and reliable variable system capacity control, without leakage that sacrifices system peak capacity.

20 Claims, 2 Drawing Sheets

CAPACITY CONTROL FOR ECONOMIZER REFRIGERATION SYSTEMS

BACKGROUND OF THE INVENTION

The present invention relates generally to capacity control for refrigeration systems, and more particularly to a process and system for varying the capacity of a refrigeration system employing an economizer.

In refrigeration systems, a refrigerant gas is compressed by a compressor and passed to a condenser where it exchanges heat with another fluid such as the ambient air. From the condenser, the pressurized refrigerant passes through an expansion device and then to an evaporator, where it exchanges heat with another fluid that is used to cool an environment. The refrigerant returns to the compressor from the evaporator and the cycle is repeated.

Economizer circuits are utilized in refrigeration systems to provide increased cooling capacity, and also to increase efficiency and performance of the system. An economizer circuit is sometimes incorporated just downstream of the condenser, where it produces a cooling effect on the pressurized liquid refrigerant flowing from the condenser on its way to the expansion device and the evaporator. By lowering the pressure of some liquid refrigerant sourced from the condenser and then returning the lower pressure refrigerant to the main liquid refrigerant line upstream of the primary expansion device, the economizer lowers the enthalpy of the liquid refrigerant, thereby increasing the differential enthalpy achieved by the system.

Economizer circuits typically include a refrigerant line communicably connected to the condenser or to the main refrigerant line downstream of the condenser, an economizer expansion device, and an economizer heat exchanger. A flash tank can easily serve as a heat exchanger in an economizer circuit. In flash tank economizer circuits, the economizer expansion device is provided upstream of the flash tank, and is communicably connected to an inlet provided in the upper portion of the flash tank. Liquid refrigerant flows through the expansion device, through the inlet, and into the flash tank. Upon passing through the expansion device, the liquid refrigerant experiences a substantial pressure drop, whereupon, at least a portion of the refrigerant rapidly expands or "flashes" and is converted from a liquid phase to a gas phase. The unflashed liquid refrigerant gathers at the bottom of the tank for return to the main refrigerant line upstream of the primary expansion device. Gas phase refrigerant is returned to the compressor, whether to compressor suction or to an intermediate stage of compression. As a result of the intermediate pressure of refrigerant gas in the flash tank, the gas returned to the compressor requires less compression, thereby increasing compressor efficiency.

To further control the cooling or heating capacity of the system, it is desirable to have the capability of turning the economizer circuit on or off or activating or deactivating the economizer circuit. Thus, a shut-off valve can be provided in some known economizer circuits, as further described below.

To create variable capacity control and to maintain a tight tolerance in suction pressure and/or refrigerated space temperature, it is typical to control capacity by cycling or unloading compressors. Unloading of screw compressors typically involves providing at least one capacity control valve at a predetermined stage of compression. Opening the capacity control valve allows a portion of the refrigerant gas to escape from the compression chamber, leaving less gas for compression. Thus, the load on the screw compressor is decreased, thereby increasing compressor efficiency.

There exist several known capacity control valves for reducing system capacity or "unloading" of compressors. For example, slide valves and plug valves can be used to open and close a capacity control opening that connects the compression chamber to a bypass circuit that returns gas from an intermediate stage of the screw compressor to the suction inlet, or to a lower-pressure stage of the screw compressor. The bypass circuit and capacity plug valves provide a single predetermined or "stepped" capacity decrease. This is because plug valves operate in just two positions—fully open, and fully closed. When open, the capacity plug valve channels some gas from its fixed load point in the compressor through the bypass channel back to compressor suction. When closed, the capacity plug valve allows the compressor to operate at full compression capacity. Because capacity plug valves can only operate in two positions, opening the valve provides fixed unloading of capacity, but does not provide for any variable unloading of capacity.

In contrast, slide valves provide for variable control of a capacity control opening in a compression chamber. Slide valves generally include a flat slide plate that is exteriorly slideably mounted over a capacity control opening. Slide valves can be hydraulically controlled to adjustably cover the capacity control opening, thus adjustably unloading to reduce system capacity. One drawback to slide valves is that the inherent structural limitations make it difficult, if not impossible, to eliminate compressor leakage around the slide valve even when fully closed. Such slide valve leakage can seriously hamper system efficiency, and can also limit the peak capacity of the system. In addition, slide valves can be difficult and expensive to machine.

There are several known systems employing both an economizer circuit and a capacity control valve for unloading the compressor. For example, U.S. Pat. No. 5,816,055 to Öhman is directed to apparatus and methods for controlling the efficiency and capacity of an economizer circuit having a flash tank heat exchanger. Öhman discloses the use of an adjustable control valve in an economizer circuit that regulates the flow of gaseous refrigerant from the flash tank to the compressor. The control valve also simultaneously controls a bypass return channel from the compressor to suction. Öhman discloses that system capacity can be maximized by opening the valve so as to allow higher gas return from the economizer flash tank to the compressor, which opening simultaneously fully closes the bypass return channel. Modulating the adjustable valve to decrease gas flow from the economizer, thus opening the bypass channel, decreases system capacity to between 75% and 100%. Finally, fully closing the adjustable valve shuts off the economizer circuit and leaves the bypass channel fully open to minimize system capacity to between 40% and 75%. Further lowering of capacity to 25% is also disclosed by shaping of the valve body and the bypass channel.

By way of further example, U.S. Pat. No. 6,385,980 to Sienel is directed to apparatus and methods for controlling the efficiency and capacity of a flash tank in an economizer circuit. The Sienel patent discloses the use of expansion valves to control the flow of refrigerant into and out of the flash tank, thereby regulating the amount of refrigerant stored in the flash tank, and in turn controlling the amount of refrigerant in the condenser and the high pressure side of the system. A first expansion valve regulates the flow of liquid refrigerant from the condenser into the flash tank, and a second expansion valve regulates the flow of liquid refrigerant charge out of the flash tank. The Sienel patent further discloses that an additional control valve can be provided to control the flow of refrigerant gas from the flash tank to the compressor, and that closing that particular valve will turn off the economizer by blocking vapor refrigerant from exiting the flash tank and entering the compressor.

Lastly, U.S. Pat. No. 6,385,981 to Vaisman is directed to a method of reducing cooling capacity in a refrigeration system having a main circuit, an economizing circuit, and a capacity control bypass circuit. The main circuit comprises a compressor, a condenser unit, an expansion device, an evaporator unit, connecting piping and appropriate refrigeration control. The compressor includes an economizer port located in the compression region, and a variable flow valve associated with the economizer port. The economizer circuit includes a first solenoid valve, an additional expansion device and an economizing heat exchanger. The bypass circuit also has a solenoid valve that acts as a shut-off for the bypass circuit. A control system activates the valves based on a capacity demand. The system disclosed in Vaisman includes a single compressor port that controls access to both the bypass circuit and to the economizer circuit, to thereby prevent the economizer and the capacity control bypass circuit from being operated simultaneously.

Therefore, there exists a continuing need for an economizer-equipped refrigeration system that provides for operation of at least one capacity control valve controlling an independent bypass circuit simultaneously with the operation of an independent modulating control valve to variably control a separate economizer circuit to permit efficient, flexible, reliable, and variable system capacity control, without leakage that can reduce system peak capacity.

SUMMARY OF THE INVENTION

An economizer-equipped refrigeration system is provided, the system including a refrigeration circuit including at least one compressor, a condenser, and an evaporator communicably connected in a closed loop. The at least one compressor includes a compression mechanism for compressing a refrigerant gas, the compression mechanism having a suction inlet, a discharge outlet and at least one stage of compression between the suction inlet and discharge outlet. The at least one stage of compression includes at least one capacity control valve configured and disposed to control a capacity control opening in the compression mechanism, the capacity control opening communicably connecting the at least one stage of compression to at least one bypass circuit. The at least one bypass circuit is in fluid communication with the capacity control opening and the suction inlet. The system further includes an economizer circuit, the economizer circuit comprising: a flash tank having a refrigerant inlet in fluid communication with the condenser, a liquid outlet in fluid communication with the evaporator, and a gas outlet in fluid communication with the at least one stage of compression. The system further includes: a gas return line being separate from the at least one bypass circuit, the gas return line in fluid communication with the gas outlet and the at least one stage of compression; a first modulating valve disposed in the gas return line to adjustably control the flow of gas from the gas outlet of the flash tank to the at least one stage of compression; and a control panel for controlling operation of the at least one capacity control valve and the first modulating valve.

A method is provided for varying the capacity of an economizer-equipped refrigeration system, the method comprised of the steps of: providing a refrigeration system comprising a refrigeration circuit comprising at least one compressor, a condenser, and an evaporator communicably connected in a closed loop, wherein the at least one compressor includes a compression mechanism for compressing a refrigerant gas, the compression mechanism having a suction inlet, a discharge outlet and at least one stage of compression between the suction inlet and discharge outlet; the at least one stage of compression including at least one capacity control valve configured and disposed to control a capacity control opening in the compression mechanism, the capacity control opening communicably connecting the at least one stage of compression to at least one bypass circuit; and the at least one bypass circuit being in fluid communication with the capacity control opening and the suction inlet; the system including an economizer circuit, the economizer circuit comprising: a flash tank having a refrigerant inlet in fluid communication with the condenser, a liquid outlet in fluid communication with the evaporator, and a gas outlet in fluid communication with the at least one stage of compression; and a gas return line being separate from the at least one bypass circuit, the gas return line in fluid communication with the gas outlet and the at least one stage of compression; and a first modulating valve disposed in the gas return line to adjustably control the flow of gas from the gas outlet of the flash tank to the at least one stage of compression; and a control panel for controlling operation of the at least one capacity control valve and the first modulating valve. The method further includes the steps of selecting a system parameter setpoint for the refrigeration system; operating the refrigeration system; measuring the parameter of the operating refrigeration system; comparing the measured parameter to the setpoint; and adjusting system capacity by operating at least one of the at least one capacity control valve and the first modulating valve in response to the comparison of the measured parameter pressure and the parameter setpoint.

An advantage of the present invention is that it permits simultaneous operation of at least one capacity control valve controlling an independent bypass circuit simultaneously with operation of an independent control valve to variably control the economizer circuit to permit efficient, flexible, reliable, and variable system capacity control.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

The subject matter of the invention is directed to a process and system that can vary the capacity of a refrigeration system employing or incorporating an economizer. The process and system can be used with any type of compressor, but is preferably used with screw compressors.

The process and system provides for almost infinite capacity adjustment of an economizer-equipped refrigeration system by a combination of controlling at least one capacity plug valve that controls a capacity control opening located in the compression chamber, and by simultaneously controlling the gas outlet of the economizer to adjust the amount of gas returned to the compressor.

As previously described, capacity plug valves operate in just two positions—fully open, and fully closed. When open, the capacity plug valve channels some gas from its fixed load point in the compression chamber or compression stage back to the compressor suction, thereby reducing system capacity ("unloading"). When closed, the capacity plug valve allows the compressor to operate at full compression capacity. Because capacity plug valves can only operate in two positions, opening a single capacity plug valve provides a single predetermined or "stepped" capacity decrease. While additional unloading can be provided by the opening of a second capacity plug valve, the additional unloading is also stepped, and does not provide for infinitely variable capacity control. To smooth each capacity step resulting from opening of one or more capacity plug valves, and to provide for a nearly infinitely adjustable unloading of system capacity that equates to a seamless unloading curve, the present invention provides for throttling of the economizer gas outlet, such as by operating a modulating valve provided on the gas outlet of the economizer circuit.

Figure 1:
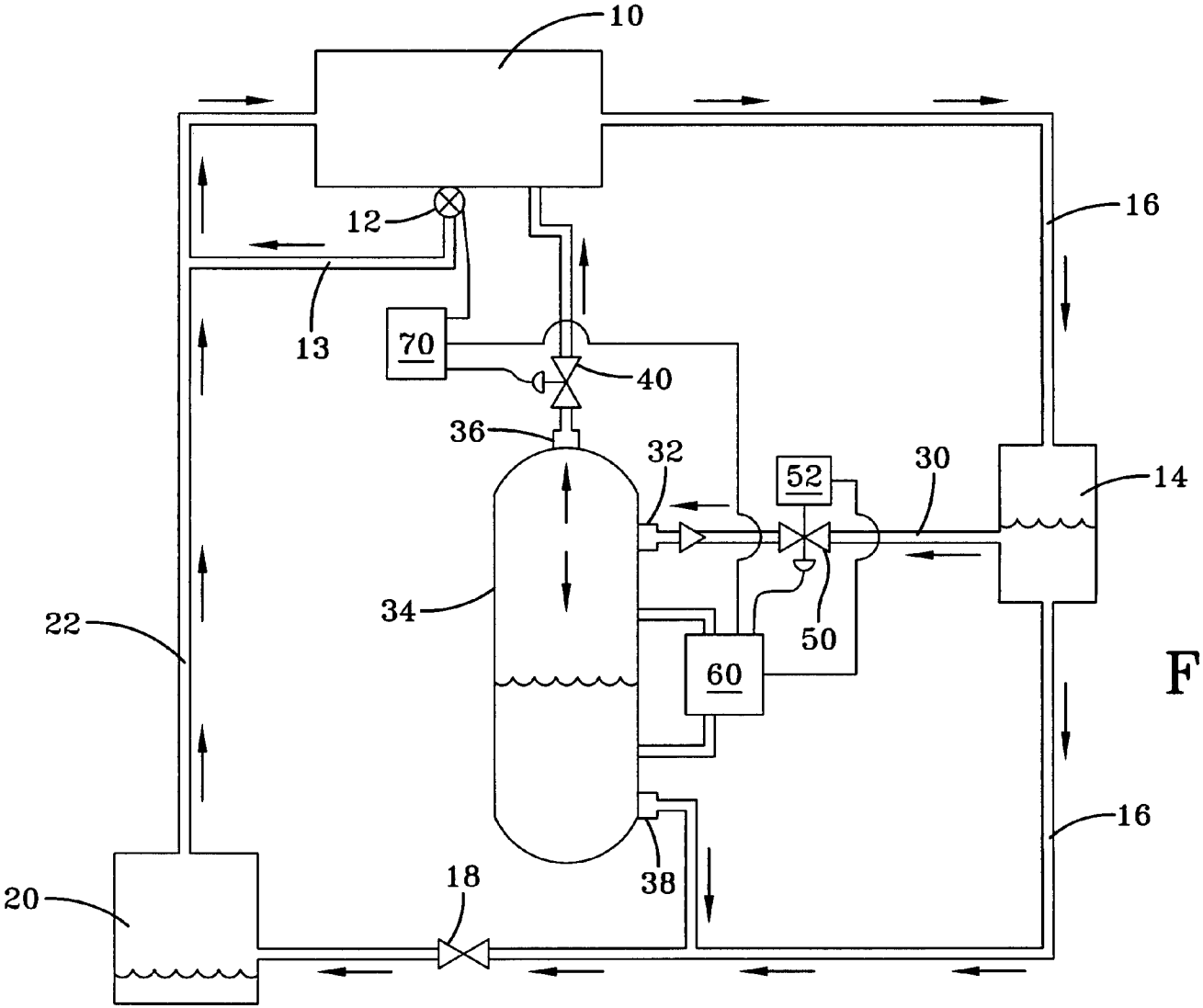
FIG. 1 schematically illustrates a system in accordance with one embodiment of the present invention.

FIG. 1 schematically illustrates an exemplary refrigeration system of the present invention. As shown, the refrigeration system includes a compressor 10 driven by a motor, a condenser 14, an evaporator 20. A main refrigerant line 16 connects the compressor 10 to the condensor 14, and connects the condensor 14 to the evaporator 20. The main refrigerant line 16 includes a primary expansion device 18 located between the condensor 14 and the evaporator 20. The evaporator 20 is connected to the compressor by a suction pipe 22, thus completing the refrigeration circuit.

The compressor 10 compresses a refrigerant vapor and delivers the vapor to the condenser 14 through the main refrigerant line 16. The refrigerant is preferably R134a, but can be any known refrigerant type that is suitable for an economizer circuit. The compressor 10 is preferably a screw compressor, but can be a centrifugal compressor, a scroll compressor, a reciprocating compressor, or any other compressor type that is compatible for use with an economizer circuit. The refrigerant vapor delivered by the compressor 10 to the condenser 14 enters into a heat exchange relationship with a fluid, e.g., air or water, and undergoes a phase change to a refrigerant liquid as a result of the heat exchange relationship with the fluid. The condensed liquid refrigerant from the condenser 14 flows through a primary expansion device 18 to the evaporator 20.

The evaporator 20 can be of any known type. For example, the evaporator 20 may include a heat-exchanger coil having a supply line and a return line connected to a cooling load. The heat-exchanger coil can include a plurality of tube bundles within the evaporator 20. A secondary liquid, which is preferably water, but can be any other suitable secondary liquid, e.g., ethylene, calcium chloride brine or sodium chloride brine, travels in the heat-exchanger coil into the evaporator 20 via a return line and exits the evaporator via a supply line. The refrigerant liquid in the evaporator 20 enters into a heat exchange relationship with the secondary liquid in the heat-exchanger coil to chill the temperature of the secondary liquid in the heat-exchanger coil. The refrigerant liquid in the evaporator 20 undergoes a phase change to a refrigerant vapor as a result of the heat exchange relationship with the secondary liquid in the heat-exchanger coil. The low-pressure gas refrigerant in the evaporator 20 exits the evaporator 20 and returns to the compressor 10 by a suction pipe 22 to complete the cycle. While the system has been described in terms of preferred embodiments for the condenser 14 and evaporator 20, it is to be understood that any suitable configuration of condenser 14 and evaporator 20 can be used in the system 100, provided that the appropriate phase change of the refrigerant in the condenser 14 and evaporator 20 is obtained.

In the particular system of FIG. 1, the refrigeration circuit further includes an economizer circuit. The economizer circuit is provided between the condenser 14 and the main refrigerant line 16 upstream of the primary expansion device 18 leading to the evaporator 20. The economizer circuit has a liquid refrigerant line 30 connecting the condenser 14 to a flash tank 34, with an economizer expansion device 32 provided upstream of the flash tank 34. The flash tank 34 has a refrigerant inlet 36 for receiving refrigerant sourced from the condenser 14, a gas outlet 36, and a liquid outlet 38. The liquid outlet 38 is communicably connected to the main refrigerant line 16 upstream of the primary expansion device 18. The gas outlet 36 is communicably connected to an intermediate stage of compression in the compressor 10 by a gas return line. The gas outlet 36 is controlled by a modulating gas control valve 40, the valve 40 proving for infinite adjustment of gas flow through the gas outlet 36 for return to a lower pressure stage of compression in the compressor 10. Control of the gas control valve 40 thus controls the capacity of the economizer circuit.

In order to maintain a relatively constant liquid level in the flash tank 34, a second modulating valve 50 is preferably provided in the economizer liquid line 30. Depending upon the position of the gas control valve 40, the second modulating valve 50 can be adjusted to control liquid flow from the condenser into the flash tank 34 to ensure an adequate liquid level is maintained in the flash tank 34. Preferably, the liquid level in the flash tank 34 is monitored by a level-sensing device 60, the device 60 communicably connected to a control 52 for adjusting the second modulating valve 50.

To enable unloading, the compressor 10 has a single capacity control opening provided at an intermediate stage of compression. The capacity control opening is controlled by a capacity control valve 12. The capacity control valve 12 is preferably a plug valve, but can also be a slide valve. A bypass circuit 13 is provided to connect the capacity control opening to compressor suction. In another embodiment the bypass circuit 13 is configured to connect the capacity control opening to an earlier stage of compression. Although a single capacity control valve 12 and bypass circuit 13 are shown in FIG. 1, a plurality of capacity control valves 12 and bypass circuits 13 can be provided. Additionally, multiple capacity control valves 12 can be connected to a single bypass circuit 13. The size of the control openings, valves 12 and bypass circuits 13 can be adjusted to provide a predetermined level of unloading for a particular compressor refrigeration system. The conventional refrigeration system includes many other features that are not shown in FIG. 1. These features have been purposely omitted to simplify the drawings for ease of illustration.

Flexible control of capacity of the system 100 is accomplished by selectively opening and closing the capacity control valve 12 in combination with modulating the gas control valve 40. For example, unloading can be accomplished by adjusting the gas control valve 40 to throttle the gas outlet 36 of the economizer flash tank 34, while the capacity control valve 12 remains closed, to reach between 99% and 78% of system capacity. In this embodiment, the gas control valve 40 can be variably opened to allow the economizer to contribute a capacity increase of up to about 22%. To further decrease system capacity from between about 78% to about 58%, the capacity control valve 12 is opened, and the gas control valve 40 is adjusted to the extent necessary to regulate the economizer gas outlet flow to contribute an offsetting increase in capacity to obtain the desired system capacity. Further unloading to below 58% system capacity can be accomplished in the above example by including additional capacity control valves 12 (each valve 12 controlling a capacity control opening linked to at least one bypass circuit 13 connected to suction) to further reduce compressor capacity, with the gas control valve 40 being variably modulated to allow the economizer to contribute an offsetting increase in capacity to reach desired system capacity. The second modulating valve 50 is also adjustably opened or closed, such as by a control 60 linked to a liquid level sensor, in order to regulate flow of refrigerant to the flash tank 34 to maintain a relatively constant liquid level in the tank 34.

Additionally, in a two-compressor embodiment that incorporates the features of the above exemplary system, system capacity can be accomplished by any combination of turning off one compressor 10, controlling one or more capacity control valves 12, and modulating a gas control valve 40 on each economizer circuit for each operating compressor 10, as previously described. In this embodiment, capacity can be reduced to as low as about 30% of the total system capacity using the control methods as described.

The system 100 is controlled by a control, such as a control panel 70. Preferably, the control panel 70 includes a microprocessor or controller to provide control signals to operate the valves and other system components. The valves and other components can be operated by any suitable device, such as solenoids, motorized valve controls, and the like. In a preferred embodiment, the control panel 70 executes a control algorithm(s) or software to determine and implement an operating configuration for the valves of the system to controllably adjust system capacity. The control algorithm or software of the control panel can preferably also determine, implement, and control the operation of other system components such as the speed of any condenser fans and the speed of each compressor 10. In one embodiment, the control algorithm(s) can be computer programs or software stored in the non-volatile memory of the control panel 70 and can include a series of instructions executable by the microprocessor of the control panel 70. While it is preferred that the control algorithm be embodied in a computer program(s) and executed by the microprocessor, it is to be understood that the control algorithm may be implemented and executed using digital and/or analog hardware by those skilled in the art. If hardware is used to execute the control algorithm, the corresponding configuration of the control panel 70 can be changed to incorporate the necessary components and to remove any components that may no longer be required.

Figure 2:
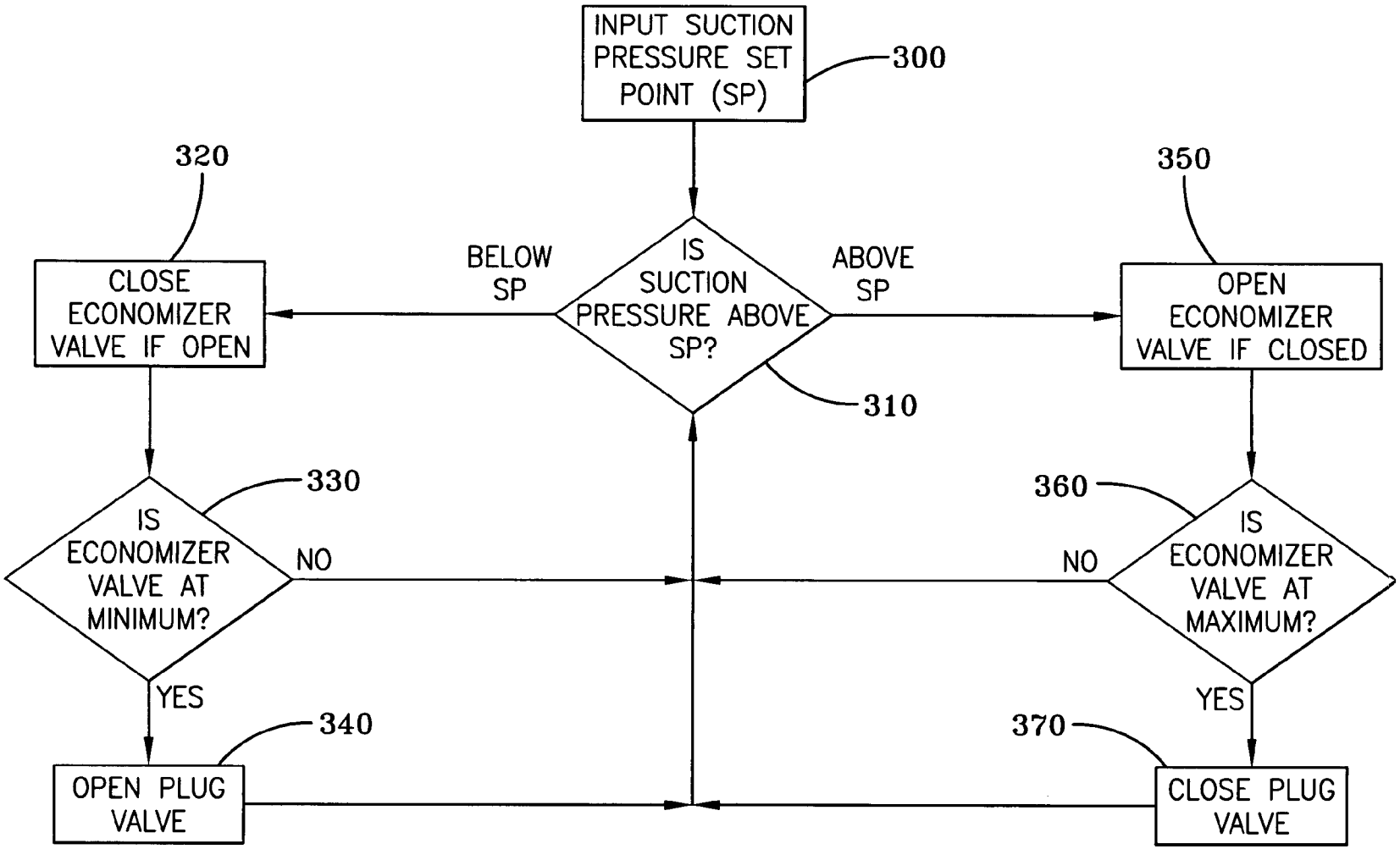
FIG. 2 illustrates a control algorithm in accordance with one embodiment of the present invention.

FIG. 2 illustrates an exemplary control algorithm for practicing the methods of the present invention. In step 300, a user inputs a setpoint based on a selected system parameter. Preferably, the setpoint is stored in the non-volatile memory of the microprocessor of the control panel 70. The setpoint can be pre-programmed, but can preferably be adjusted by authorized personnel. Preferably, the selected system parameter is suction pressure. However, other system parameters such as suction temperature, leaving chilled liquid temperature, refrigerant temperature, discharge pressure, and other known refrigeration system parameters can also be used as the system parameter used by the control algorithm to react to adjust system capacity. In any case, the setpoint is monitored in the control algorithm to adjust system capacity, and in particular to control the operation of each gas control valve 40, capacity control valve 12, and modulating valve 50 to adjust system capacity. In the exemplary control method of FIG. 2, in step 310, the actual system suction pressure, whether measured or calculated based on other measurements, is compared to the suction pressure setpoint. If the actual suction pressure is below the setpoint, the method proceeds to step 320 to adjustably close the gas control valve 40. The method then proceeds to step 330. In step 330, the method determines whether the gas control valve 40 is fully closed. If the gas control valve 40 is not fully closed, the method returns to step 310. If the gas control valve is fully closed, the method proceeds to step 340. In step 340, at least one capacity control valve 12 is opened, whereafter the method returns to step 310.

If the actual suction pressure at step 310 is above the suction pressure set point, the method proceeds to step 350. In step 350, the economizer gas control valve 40 is adjustably opened. In step 360, the method determines whether the valve 40 is fully open. If the gas control valve 40 is not fully open, the method returns to step 310. If the gas control valve 40 is fully open, the method proceeds to step 370. In step 370, at least one capacity control valve 12 is closed, whereafter the method returns to step 310. It is to be understood that the above method can further include steps to monitor the liquid level in the flash tank 34 of the system and to adjustably open or close the second modulating valve 50 to maintain an acceptable level of liquid in the flash tank 34.

The valves are controlled in response to demand for increased or decreased capacity based on comparison of the monitored system parameter compared to the system parameter setpoint. The degree of adjustment of the modulating valves 40, 50 will depend upon the capacity and architecture of the system 100. However, the adjustments to the valves, and the resulting change in system capacity, are preferably made at preselected increments. For example, adjustments can be made in 5% increments in response to a measured change in the measured system parameter. Each adjustment is also preferably followed by a period of system operating time to allow the system to stabilize before further adjustments are made to the valve settings.

While the invention has been described with reference to several preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A refrigeration system, the system comprising:

a refrigeration circuit comprising at least one compressor, a condenser, and an evaporator communicably connected in a closed loop, the at least one compressor comprising:

a compression mechanism for compressing a refrigerant gas, the compression mechanism having a suction inlet, a discharge outlet and at least one stage of compression between the suction inlet and discharge outlet;

the at least one stage of compression including at least one capacity control valve configured and disposed to control a capacity control opening in the compression mechanism, the capacity control opening communicably connecting the at least one stage of compression to at least one bypass circuit; and the at least one bypass circuit being in fluid communication with the capacity control opening and the suction inlet; and an economizer circuit, the economizer circuit comprising:

a flash tank having a refrigerant inlet in fluid communication with the condenser, a liquid outlet in fluid communication with the evaporator, and a gas outlet in fluid communication with the at least one stage of compression;

a gas return line being separate from the at least one bypass circuit, the gas return line in fluid communication with the gas outlet and the at least one stage of compression; and a first modulating valve disposed in the gas return line to adjustably control the flow of gas from the gas outlet of the flash tank to the at least one stage of compression; and a control panel for controlling operation of the at least one capacity control valve and the first modulating valve.

2. The system of claim 1, wherein the capacity control valve is a capacity plug valve or a slide valve.

3. The system of claim 1, wherein the compressor is a screw compressor, a scroll compressor, a centrifugal compressor, or a reciprocating compressor.

4. The system of claim 1, wherein the refrigerant gas is R134a.

5. The system of claim 4, wherein the compressor is a screw compressor.

6. The system of claim 1, wherein the at least one bypass circuit communicably connects an intermediate stage of compression to suction.

7. The system of claim 1, wherein the at least one bypass circuit communicably connects an intermediate stage of compression to an earlier stage of compression.

8. The system of claim 1, wherein the economizer circuit further includes a second modulating valve, the second modulating valve configured to adjustably control the flow of liquid refrigerant from the condenser to the flash tank.

9. The system of claim 8, wherein the second modulating valve is in communicable connection with the control panel, the control panel configured to modulate the second valve based upon the level of liquid refrigerant in the flash tank.

10. The system of claim 8, wherein the at least one compressor is comprised of at least two compressors, the compressors configured so as to permit variable capacity control by selective operation of one or both compressors in combination with selective operation of the at least one capacity control valve, the first modulating valve, and the second modulating valve.

11. The system of claim 8, wherein the control panel includes a capacity control algorithm executable by the control panel to compare an actual system parameter against a setpoint for the system parameter, and to adjustably control operation of the at least one capacity control valve and the first modulating valve based on the comparison of the actual system parameter to the setpoint.

12. A method of varying the capacity of an economizer-equipped refrigeration system, the method comprised of the steps of:

providing a refrigeration system comprising:

a refrigeration circuit comprising at least one compressor, a condenser, and an evaporator communicably connected in a closed loop, the at least one compressor comprising:

a compression mechanism for compressing a refrigerant gas, the compression mechanism having a suction inlet, a discharge outlet and at least one stage of compression between the suction inlet and discharge outlet;

the at least one stage of compression including at least one capacity control valve configured and disposed to control a capacity control opening in the compression mechanism, the capacity control opening communicably connecting the at least one stage of compression to at least one bypass circuit; and the at least one bypass circuit being in fluid communication with the capacity control opening and the suction inlet; and an economizer circuit, the economizer circuit comprising:

a flash tank having a refrigerant inlet in fluid communication with the condenser, a liquid outlet in fluid communication with the evaporator, and a gas outlet in fluid communication with the at least one stage of compression;

a gas return line being separate from the at least one bypass circuit, the gas return line in fluid communication with the gas outlet and the at least one stage of compression; and a first modulating valve disposed in the gas return line to adjustably control the flow of gas from the gas outlet of the flash tank to the at least one stage of compression; and a control panel for controlling operation of the at least one capacity control valve and the first modulating valve;

inputting a system parameter setpoint for the refrigeration system, the setpoint based on a selected system parameter;

operating the refrigeration system;

measuring the selected system parameter of the operating refrigeration system;

comparing the measured system parameter to the setpoint; and adjusting system capacity by operating at least one of the at least one capacity control valve and the first modulating valve in response to the comparison of the measured system parameter and the setpoint.

13. The method of claim 12, wherein the system parameter is at least one of suction pressure, suction temperature, leaving chilled fluid temperature, refrigerant temperature, and discharge pressure.

14. The method of claim 13, wherein the step of adjusting system capacity includes opening of the at least one capacity control valve and results in a reduction of system capacity of between about 1 percent to about 25 percent.

15. The method of claim 14, wherein the step of adjusting system capacity is further comprised of the step of adjusting system capacity to a preselected level by adjustably operating the first modulating control valve to adjust the flow of gas through the economizer gas outlet for return to the compressor.

16. The method of claim 15, wherein the step of adjusting system capacity to a preselected level results in an additional adjustment of system capacity of between about 1 percent to about 30 percent.

17. The method of claim 15, wherein the step of opening the at least one capacity control valve is performed substantially simultaneously with the step of adjustably operating the first modulating control valve.

18. The method of claim 15, further comprised of the step of operating a second modulating valve configured and disposed to adjustably control the flow of liquid refrigerant from the condenser of the refrigeration system into the flash tank.

19. The method of claim 18, further comprised of the step of opening at least one additional capacity control valve to allow gas to escape from the at least one stage of compression through at least one bypass circuit.

20. The method of claim 19, wherein the step of opening at least one additional capacity control valve results in an additional reduction of system capacity of between about 15 percent to about 50 percent.

* * * * *